US005727714A

United States Patent [19]

Fawcett

[11] Patent Number: 5,727,714

[45] Date of Patent: Mar. 17, 1998

[54] PERSONAL HYDRATION DEVICE WITH IMPROVED EXIT VALVE

[75] Inventor: Roger R. Fawcett, Weatherford, Tex.

[73] Assignee: FasTrak Systems, Inc., Weatherford, Tex.

[21] Appl. No.: 703,862

[22] Filed: Aug. 27, 1996

[51] Int. Cl.[6] ..... B67D 5/64

[52] U.S. Cl. ..... 222/175; 222/529

[58] Field of Search ..... 222/175, 527, 222/529, 92; 224/148.4, 148.5, 148.6

[56] References Cited

U.S. PATENT DOCUMENTS

| | | | |
|---|---|---|---|
| 2,095,351 | 10/1937 | Van Winkle . | |
| 4,139,130 | 2/1979 | Glusker et al. . | |
| 5,085,349 | 2/1992 | Fawcett . | |
| 5,115,947 | 5/1992 | McDonnell et al. . | |
| 5,431,308 | 7/1995 | Tchen . | |
| 5,566,869 | 10/1996 | Katz | 224/148.6 |

*Primary Examiner*—Gregory L. Huson
*Attorney, Agent, or Firm*—Kolishch, Hartwell, Dickinson, McCormach & Heuser

[57] ABSTRACT

A personal hydration device for use in providing fluid for delivery to an individual, the hydration device including a flexible bladder configured to hold fluid and including opposing side walls, at least one of the side walls having an opening through which the fluid may be passed. The device also includes an exit valve joined to the bladder adjacent the opening, where the exit valve includes a generally conically-shaped fluid accumulator region with a broad base disposed over at least part of the opening to receive fluid therefrom and the accumulator region extends from the broad base to a narrower peak. The exit valve includes an output port which connects to the accumulator region adjacent the peak. A flexible hose with first and second ends, the first end being connected to the output port and the second end being connected to a mouthpiece configured to be placed in the individual's mouth to provide fluid delivery thereto.

9 Claims, 2 Drawing Sheets

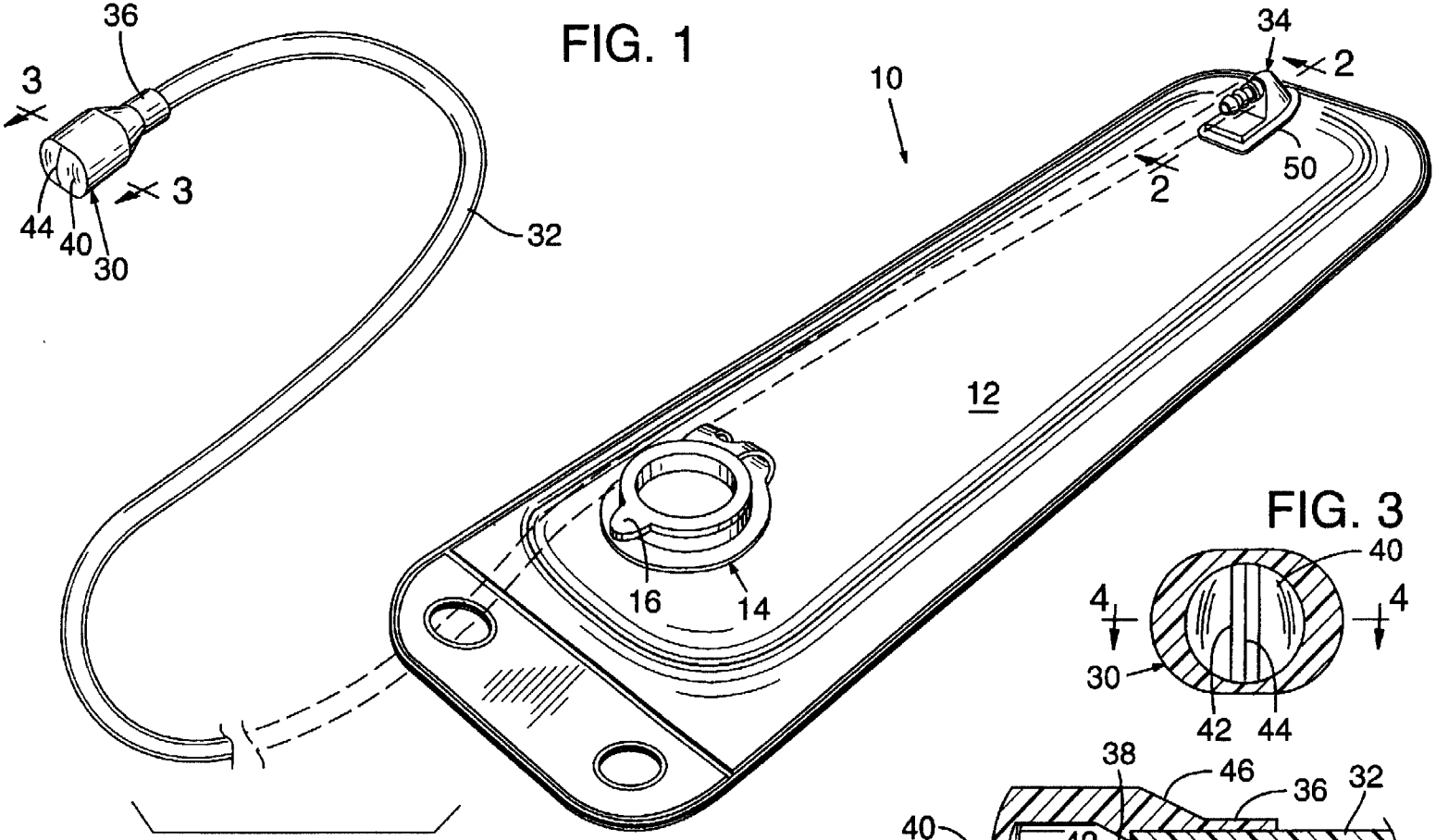
FIG. 1
FIG. 3
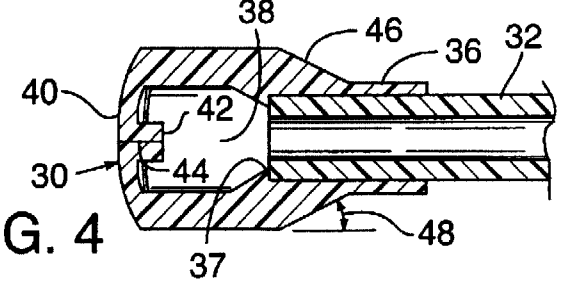
FIG. 4

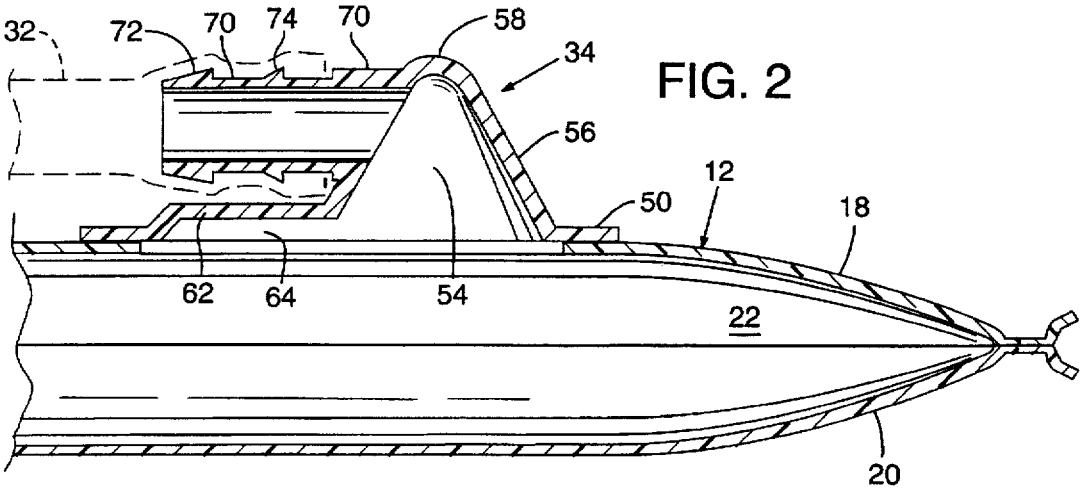
FIG. 2
FIG. 5
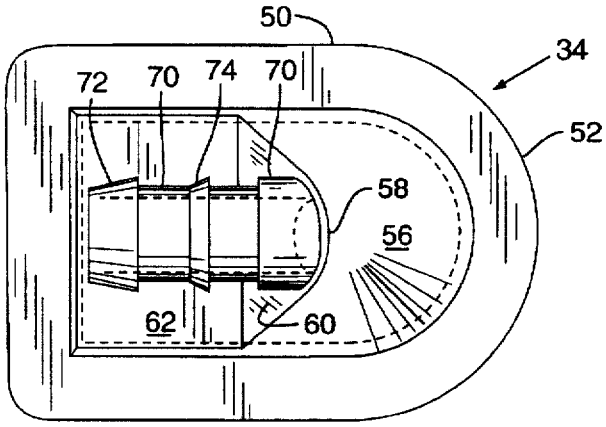
FIG. 6
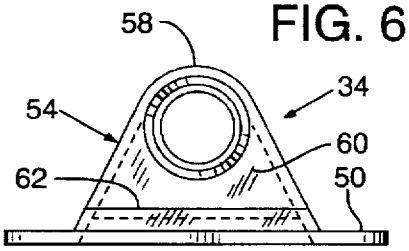
FIG. 7
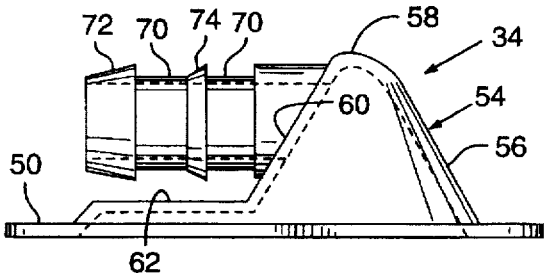

PERSONAL HYDRATION DEVICE WITH IMPROVED EXIT VALVE

BACKGROUND

The invention generally relates to water storage devices and more particularly to a personal hydration device with an exit valve structure configured to provide improved water flow and reduced blockage.

FIELD OF THE INVENTION

Medical research has demonstrated the importance of maintaining adequate hydration while engaging in strenuous physical activities, such as bicycling or mountain climbing. In the not too distant past, participants in such activities carded their water in bottles or canteens from which they drank periodically. More recently, personal hydration devices have been developed which allow users to drink more or less continuously. These personal hydration devices typically have a bag-like water reservoir that is carded in a small back-mounted pack. A long flexible hose is connected to the reservoir through a valve at one end and terminates in a mouthpiece at the other end. The hose is long enough to allow the user to carry the mouthpiece in their mouth and draw water from the reservoir at will.

Although personal hydrator devices have proven to be a great advance over traditional water bottles, they do suffer from some drawbacks. In particular, because of the mouthpiece, the long hose and the structure of the valve used in existing devices, it is oftentimes difficult for the user to draw an acceptable flow of water from the reservoir. In addition, because the reservoir bag is normally formed from a flexible material, the entrance to the valve from the bag can easily be obstructed by the opposite side of the bag when the user applies suction to the mouthpiece. This can completely shut off water flow to the user.

Another limitation of existing personal hydration device designs is the difficulty in cleaning. Specifically, it is difficult to clean the inside of the hose and the bag. In known devices, the hose is permanently attached to the bag and so is more difficult to clean and cannot even easily be replaced. Replacing the hose may also be beneficial in providing flexibility to the user in the length of the hose.

It is therefore an object of the present invention to provide a personal hydration device from which a user can draw adequate flows of fluid.

Another object of the present invention is to provide a personal hydration device with an exit valve that is not subject to blockage.

One more object of the present invention is to provide such a device in which the hose can be removed for easier cleaning and replacement.

SUMMARY OF THE INVENTION

The present invention is a personal hydration device for use in providing fluid for delivery to an individual. The hydration device includes a flexible bladder configured to hold fluid and having opposing side walls, at least one of the side walls having an opening through which the fluid may be passed. The device also includes an exit valve joined to the bladder adjacent the opening, where the exit valve includes a generally conically-shaped fluid accumulator region with a broad base disposed over at least part of the opening to receive fluid therefrom and the accumulator region extends from the broad base to a narrower peak. The exit valve includes an output port which connects to the accumulator region adjacent the peak. A flexible hose with first and second ends, the first end being connected to the output port and the second end being connected to a mouthpiece configured to be placed in the individual's mouth to provide fluid delivery thereto.

Many other features, advantages and additional objects of the present invention will become manifest to those versed in the art upon making reference to the detailed description which follows and the accompanying sheets of drawings in which preferred embodiments incorporating the principles of this invention are disclosed as illustrative examples only.

BRIEF DESCRIPTION OF THE DRAWINGS

FIG. 1 is a perspective view of a personal hydration device according to the present invention.

FIG. 2 is cross-sectional view of the device of FIG. 1 along line 2—2.

FIG. 3 is a cross-sectional view of a bite valve according to the present invention along line 3—3 in FIG. 1.

FIG. 4 is a cross-sectional view of the bite valve of FIG. 3 along line 4—4.

FIG. 5 is a top elevational view of an exit valve according to the present invention.

FIG. 6 is an end elevational view of the exit valve of FIG. 5.

FIG. 7 is a side elevational view of the exit valve of FIG. 5.

DETAILED DESCRIPTION OF THE PREFERRED EMBODIMENT

A personal hydration device according to the present invention is shown generally at 10 in FIG. 1. Device 10 includes a fluid reservoir bag 12 for storing the water, juice or other liquid to be consumed by a user. Bag 12 includes filler spout 14 with a cap 16, which can be opened to empty, fill or clean the bag. As shown in FIG. 2., bag 12 is formed by welding two sheets 18, 20 of a flexible plastic material together around their periphery, to form a reservoir 22.

A mouthpiece in the form of a bite valve 30 is connected to bag 12 by a flexible hose 32, which joins to the bag at an exit valve 34. Bite valve 30 is shown in more detail in FIGS. 3 and 4 and includes a flexible neck 36 which fits over the end of hose 32 to form a watertight seal. It should be noted that the bite valve can be slipped on and off the hose for cleaning or maintenance and a catch 37 prevents the hose from being slipped too far into the valve.

Bite valve 30 also includes a supply chamber 38 which is open to neck 36 at one end to receive fluid from the hose and is closed at the opposite end by an end wall 40. A ridge 42 extends across the inside surface of end wall 40 and a slit 44 is formed in the end wall along the center of the ridge. The user, by compressing the sides of the supply chamber, can open the slit and then draw water therethrough. The purpose and effect of the ridge is to provide improved sealing of the slit under pressure as described in U.S. Pat. No. 5,085,349, which is incorporated herein by reference.

A sloping shoulder 46 extends between neck 36 and supply chamber 38 to provide a smooth transition on the bite valve. In the preferred embodiment, the shoulder tapers at an angle 48 of approximately 30-degrees, although values between 10 and 60-degrees or even a rounded shoulder should also be suitable. In prior art valve, the end of the valve formed an abrupt 90-degree edge, which proved uncomfortable when held in the user's mouth. The shoulder of the present bite valve eliminates this abrupt transition, thereby making the bite valve more comfortable for the user.

As mentioned above, hose 32 extends from the bite valve to exit valve 34. As shown in FIGS. 5–7, exit valve 34 includes a generally rectangular base flange 50 with a round end 52. Flange 50 is welded to sheet 18 of bag 12 over an opening formed in the sheet, thereby securing the valve to the bag. It should be noted that the opening over which the exit valve is mounted is disposed at one end of the bag so that when the bag is mounted to a user's back, the exit valve at the bottom can draw essentially all the water out of the bag.

A semi-conical accumulator 54 projects upwardly and inwardly from flange 50. Accumulator 54 is bounded on one side by a conical section 56 which projects up from round end 52 to a rounded peak 58. The side of accumulator 54 opposite conical section 56 is bounded by a planar section 60 of generally triangular shape. The base of planar section 60 falls about half-way along the length of the flange and joins to one edge of a raised rectangular region 62 that creates a supplemental accumulator 64. Supplemental accumulator 64 is connected to accumulator 54 at the base of planar section 60. This allows water to be drawn from supplemental accumulator 64 into accumulator 54, even when the opening from accumulator 54 into the bag is obstructed.

A short tube segment 70 projects outward from planar section 60 adjacent peak 58 to form an output port and provide an attachment point for hose 32. Tube 70 includes barbs 72, 74 to enhance the grip on the hose. Although barbs 72, 74 enhance the grip on hose 32, because the hose is formed of a flexible material, it is still possible to remove and reinstall the hose as required for cleaning or repair, or in the event a longer hose is required for a particular application.

The effect of the described valve construction is to provide a valve through which water can more easily be drawn. In particular, the gradual sloping transition presented to water flowing from the reservoir through accumulator 54 and tube 70 into hose 32 reduces turbulence and hydrodynamic drag. Moreover, the supplemental accumulator reduces the chance that water flow will be stopped by obstruction from the opposed side of the bag. This is particularly a problem as the water level in the bag is reduced and the sheets forming the bag collapse closer together. When this happens, sheet 20 can come up against flange 50 and obstructed the opening under accumulator 54. However, because of the presence of supplemental accumulator 64, fluid can still be drawn through the valve. Therefore, to stop the flow of fluid, sheet 20 would have to come up against the entire area under flange 50. Because of the size of this area, this is much less likely to happen than obstruction of the opening under accumulator 54.

Another advantage of the large area of contact between valve 34 and bag 12 is the increased mechanical stability. In particular the large contact area distributes any forces applied to the valve over a larger zone, thereby reducing the risk of separation with or tearing of the bag.

Accordingly, while a preferred embodiment of the invention has been described herein, and preferred methods associated therewith, it is appreciated that modifications are possible that are within the scope of the invention.

It is claimed and desired to secure by Letters Patent:

1. A personal hydration device for use in providing fluid for delivery to an individual, said hydration device comprising:

a flexible bladder configured to hold fluid and including opposing side walls, at least one of the side walls having an opening through which the fluid may be passed;

an exit valve joined to the bladder adjacent the opening, the exit valve including a generally conically-shaped fluid accumulator region with a broad base disposed over at least part of the opening to receive fluid therefore, the accumulator region extending from the broad base to a narrower peak, where the exit valve also includes an output port and the output port connects to the accumulator region adjacent the peak;

a flexible hose with first and second ends, the first end being connected to the output port; and a mouthpiece connected to the second end of the hose and configured to be placed in the individual's mouth to provide fluid delivery thereto.

2. The personal hydration device of claim 1, wherein the broad base has a first surface area and the output port has a second surface area, where the first surface area is substantially larger than the second surface areas.

3. The personal hydration device of claim 1, wherein the output port is generally elongate and tubular and extends in a direction generally transverse to a line extending between the peak and the base of the accumulator region.

4. The personal hydration device of claim 3, wherein the output port has an outer surface with at least one barb formed thereon to facilitate retention of the first end of the hose.

5. The personal hydration device of claim 3, wherein the output port has an circular inside cross section and intersects the accumulator region at an oblique angle, thereby increasing the surface area of the intersection between the accumulator region and the output port.

6. The personal hydration device of claim 1, wherein the exit valve further includes a supplemental fluid accumulator region in fluid connection with the conically-shaped fluid accumulator region, where the supplemental accumulator region includes a broad base disposed over the opening in the bag, the broad base of the supplemental accumulator region being at least substantially as large as the broad base of the conically shaped fluid accumulator region.

7. The personal hydration device of claim 6, wherein the exit valve further includes a base flange extending around the broad bases of the accumulator regions.

8. The personal hydration device of claim 6, wherein the output port is generally elongate and tubular and extends in a direction generally transverse to a line extending between the peak and the base of the accumulator region.

9. The personal hydration device of claim 8, wherein a supplemental accumulator region is disposed generally between the output port and the bag.

* * * * *

UNITED STATES PATENT AND TRADEMARK OFFICE

CERTIFICATE OF CORRECTION

PATENT NO. : 5,727,714
DATED : March 17, 1998
INVENTOR(S) : Roger R. Fawcett

It is certified that error appears in the above-identified patent and that said Letters Patent is hereby corrected as shown below:

Column 4,
Line 15, delete "therefore" and insert --therefrom-- therefor.
Line 37, delete "an" and insert --a-- therefor.
Line 46, delete "bag" and insert --bladder-- therefor.
Line 58, delete "bag" and insert --bladder-- therefor.

Signed and Sealed this

Third Day of July, 2001

Nicholas P. Godici

*Attest:*

*Attesting Officer*

NICHOLAS P. GODICI
*Acting Director of the United States Patent and Trademark Office*